US005503086A

United States Patent [19]

Hoffman et al.

[11] Patent Number: 5,503,086

[45] Date of Patent: Apr. 2, 1996

[54] TABLE WITH MOVABLE TOP SURFACE

[75] Inventors: D. Stephen Hoffman, High Point; W. Clark Rogers, Denton, both of N.C.

[73] Assignee: Ultra-Mek, Inc., Denton, N.C.

[21] Appl. No.: 34,495

[22] Filed: Mar. 19, 1993

[51] Int. Cl.[6] ..... A47B 11/00

[52] U.S. Cl. ..... 108/138; 108/139; 108/141

[58] Field of Search ..... 108/139, 141, 108/145, 138, 137, 72, 6, 9, 10, 99; 248/281.1, 280.1, 274, 278

[56] References Cited

U.S. PATENT DOCUMENTS

| | | | |
|---|---|---|---|
| 2,515,474 | 7/1950 | Ryder . | |
| 2,545,515 | 3/1951 | Gannett et al. . | |
| 2,630,359 | 3/1953 | Schade . | |
| 2,766,088 | 10/1956 | Jackson et al. . | |
| 2,982,050 | 5/1961 | May | 108/6 X |
| 3,195,482 | 7/1965 | Whitfield . | |
| 4,194,452 | 3/1980 | Crowther et al. | 108/138 |
| 4,237,795 | 12/1980 | Parker . | |
| 4,502,394 | 3/1985 | Veyhl . | |
| 4,515,087 | 5/1985 | Kurrasch . | |
| 4,590,865 | 5/1986 | Rutsche et al. . | |
| 4,677,919 | 7/1987 | Baggiani . | |
| 4,687,167 | 8/1987 | Skalka et al. | 108/103 X |
| 4,714,028 | 12/1987 | Uredat-Neuhoff . | |
| 4,905,610 | 3/1990 | Kelley . | |
| 4,981,085 | 1/1991 | Watt . | |
| 5,098,053 | 3/1992 | Cotterill | 108/6 X |
| 5,099,768 | 3/1992 | Kirchner | 108/139 X |
| 5,199,360 | 4/1993 | Koistinen | 108/6 X |
| 5,249,533 | 10/1993 | Moore, III | 108/138 X |

FOREIGN PATENT DOCUMENTS

| | | | |
|---|---|---|---|
| 151627 | 3/1932 | Switzerland | 108/141 |
| 8810081 | 6/1987 | WIPO | 108/141 |

*Primary Examiner*—Jose V. Chen

*Attorney, Agent, or Firm*—Bell, Seltzer, Park & Gibson

[57] ABSTRACT

Tables having a table top that is movable between a closed position atop the table base and an open position forward and above the table base are disclosed. Certain table embodiments have swivel means to permit rotation of the table top about an axis of rotation normal to the table surface. Others include mechanisms for moving the table surface between the open and the closed position that are sufficiently compact as to be suitable for use with a large majority of coffee table and end table styles.

41 Claims, 5 Drawing Sheets

TABLE WITH MOVABLE TOP SURFACE

FIELD OF THE INVENTION

This invention relates generally to tables, such as coffee tables and end tables, which are placed near a seating unit to provide a support surface for the occupants of the seating unit, and more particularly relates to tables which have a table surface which moves from its conventional position atop the base of the table to a position more convenient to the occupants of the seating unit.

BACKGROUND OF THE INVENTION

The great majority of residences today include a seating unit, such as a sofa or chair, near which is placed a table, such as a coffee table or end table. Coffee tables can provide a surface for supporting food and drink and displaying decorative items and reading materials, and can also by themselves improve the appearance of the room. Likewise, end tables can provide a support surface for these items as well as reading lamps, telephones, and the like.

One of the drawbacks of the support surfaces provided by coffee tables and end tables is the inconvenient location of the table surface relative to an occupant of the seating unit. For example, if the occupant rests a plate of food or a drinking glass on the coffee table, he must lean forward from a seated position to retrieve it; this is somewhat awkward, particularly with seating units that employ deep, soft cushions. If the occupant wishes to eat from the plate or drink from the glass, he has two options. First, he can lean over the table while eating or drinking, which is even more awkward than simply leaning over the table to retrieve the plate. Second, the occupant can grasp the plate and carefully balance it as it travels with him to the seated position, after which he must support the plate as he eats. Either of these options is unsatisfactory, as the risk of the occupant spilling food or drink onto the table, the underlying floor (which is often carpeted), or the seating unit itself, is significant.

The situation is no better with an end table; the occupant must twist to retrieve the plate or glass from the end table and either consume in this awkward twisted position or balance the plate or glass as it travels and resides over the seating unit. Often the difficulty is exacerbated by the presence of an armrest on the end of the seating unit that the occupant must negotiate.

Further, the typical coffee table provides no surface between occupants seated on either end of a sofa that can serve as a card or game table. Thus occupants of the seating unit utilizing the table for this purpose must twist awkwardly to reach the table.

The underlying cause of these difficulties is the position of the table surface relative to the seating unit. On coffee tables, the table surface is too low and too far forward for easy access to the occupant of a seating unit. On end tables, the table surface is placed beside rather than directly in front of a seated occupant. However, furniture styles dictate that coffee tables provide table surfaces in these locations.

One attempt to address this problem is disclosed in U.S. Pat. No. 2,766,088 to Jackson et al., in which a coffee table is illustrated which includes a table surface that rises and moves laterally from its base to reside in front of an occupant of an adjacent seating unit. A shortcoming of the Jackson et al. table is demonstrated when the occupant wishes to rise from the seating unit while the table is in its extended position. With the table top extended, the occupant may be pinned behind the table; either the occupant must lower the entire table surface to escape, or the table surface must be sufficiently short that it does not rest directly in front of the occupant in the extended position. A similar table is shown in Crowther et al., U.S. Pat. No. 4,194,452, which discloses a coffee table that has two separate table surfaces that can rise and retract independently. This allows the occupant pinned behind the table top to move the tabletop section directly in front of him without disturbing the tabletop in front of the other occupants. Neither of these references disclose a table that provides a tabletop that extends between occupants seated on opposite ends of a sofa. Further, each of these tabletops is moved to the extended position by a bulky mechanism that is unsuitable for many modern table styles, such as "off-the-floor" tables and tables having a base that is relatively narrow in comparison to the tabletop. For these and other examples, the mechanism would be visually exposed and thus render the table unacceptably unsightly.

In addition, the table top for many tables can be quite heavy. As a result, raising the table top can be difficult, particularly for a weak or feeble operator. Further, due to its weight, during lowering the table top can slip from the grip of the operator and slam violently into the closed position. The table disclosed in Crowther et al. includes a pneumatic cylinder attached to the table top and the lower portion of the table legs to provide resistance to the lowering action and thus prevent slamming of the table top during lowering. However, as above, this configuration is limited to table styles in which the cylinder is not exposed.

A further shortcoming of many coffee tables becomes apparent when a table is placed adjacent a seating unit which includes one or more extendable footrests. Generally, to be reasonably comfortable an extendable footrest must extend between about 18 and 30 inches from the front of the chair. The conventional positioning of a coffee table relative to a seating unit places the table so that the tabletop interferes with an extendable footrest as it extends. As a result, seating units that include a footrest must either be placed sufficiently far from the coffee table so that the footrest can be extended without interference, or the table must be moved away from the seating unit prior to the footrest being extended.

Thus it is a first object of the present invention to provide a coffee table which can provide a usable table surface in both the conventional low and forward position of a coffee table and a position more accessible for an occupant of a seating unit.

It is also an object of the present invention to provide a such coffee table that permits occupants to move to and from an adjacent seating unit without lowering the tabletop.

It is an additional object of the present invention to provide a coffee table having a movable surface that can provide a table surface between occupants seated on opposite sides of a sofa.

It is a further object to provide such a coffee table without sacrificing styling and design freedom.

Moreover, it is an object of the present invention to provide a coffee table that is suitable for use adjacent a seating unit having an extendable footrest.

It is also an object of the present invention to provide a mechanism that can smoothly move the table top of a coffee table between the closed and extended positions, and so for virtually any style table, including off-the-floor style tables and tables having a narrow base.

Another object of the present invention is to provide an end table which can provide a usable table surface in both the conventional lateral position of an end table and a position more accessible for an occupant of a seating unit, and to do so without sacrificing the usual functions provided by end tables.

It is further an object of the present invention to provide such an end table without sacrificing styling and design freedom.

SUMMARY OF THE INVENTION

These and other objects are satisfied by the present invention, which provides as a first aspect a table comprising a base, a substantially planar table surface, four bar linkage means interconnecting the table surface with the base for moving the table surface between an open position and a closed position, and swivel means for rotating the table surface about an axis of rotation normal to a plane defined by the uppermost visible surface of the table. In the closed position, the table surface is horizontally disposed adjacent and above the table base, and in the open position, the table surface is horizontally disposed above and forward of the table base. In a preferred embodiment, the table is a coffee table having an elongated table surface. In another preferred embodiment, the table is an end table having both a movable table surface and a stationary table surface, and in particular, the movable table surface is mounted to the swivel means so that the axis of rotation of the table surface is eccentric relative to the center of the table surface.

A second aspect of the present invention is a mechanism suitable for use in such a table.

A third aspect of the present invention is a table comprising a base, a substantially planar table surface, four bar linkage means that move the table surface between a closed position, wherein the table surface is horizontally disposed adjacent and above the table base, and an open position, in which the table surface is horizontally disposed above and forward of the table base; and table surface biasing means attached to the four bar linkage means for biasing the table surface toward the open position. The four bar linkage comprises: table base mounting means fixed to the base; a front pivot link pivotally interconnected to the table base mounting means at a first pivot; a rear pivot link pivotally interconnected to the table base mounting means at a second pivot, wherein the second pivot is positioned rearward of the first pivot; and table surface mounting means attached with a table surface, wherein the table surface mounting means being pivotally interconnected to the front pivot link at a third pivot, and being further pivotally interconnected to the rear pivot link at a fourth pivot which is positioned rearward of the third pivot. In the closed position, the vertical distance between the first pivot and the visible surface is less than about 4 inches, the vertical distance between the second pivot and the visible surface is less than about 4 inches, and the vertical distance between the lowermost portion of the biasing means and the visible surface is less than about 4 inches.

A fourth aspect of the present invention is a mechanism suitable for use with such a table.

A fifth aspect of the present invention is a table as described above, wherein in the closed position, the horizontal distance between the second pivot and the third pivot is between about 14 and 18 inches.

A sixth aspect of the present invention is a mechanism suitable for use in such a table.

DETAILED DESCRIPTION OF THE PREFERRED EMBODIMENTS

This invention is directed to tables that have a stationary base and a table surface which moves upwardly and laterally from the base to provide a usable raised table surface for the occupant of a chair or sofa. The table surface is moved between an open position, in which the table surface is horizontally disposed and resides directly above and adjacent the table base, and an open position, in which the table surface maintains its horizontal disposition, raises above the table surface, and translates forwardly relative to the table surface. The height and lateral movement of the table surface are controlled by a four-bar linkage attached to the table base and to the table surface. As used herein, the terms "forward" and "forwardly" refer to the direction defined by a vector extending parallel to the table surface of a table from the table toward an adjacent seating unit. Conversely, the terms "rearward" and "rearwardly" refer to the direction directly opposite the forward direction; i.e., defined by a vector parallel to the table surface extending from the table away from an adjacent seating unit. The term "lateral" and "laterally" refer to the direction defined by a vector originating in the center of the table surface and extending in the plane of the table surface perpendicular to the forward and rearward directions. The terms "inboard," "inward," and "inwardly" refer to the direction directly opposite to the direction defined above as "lateral."

Figure 1:
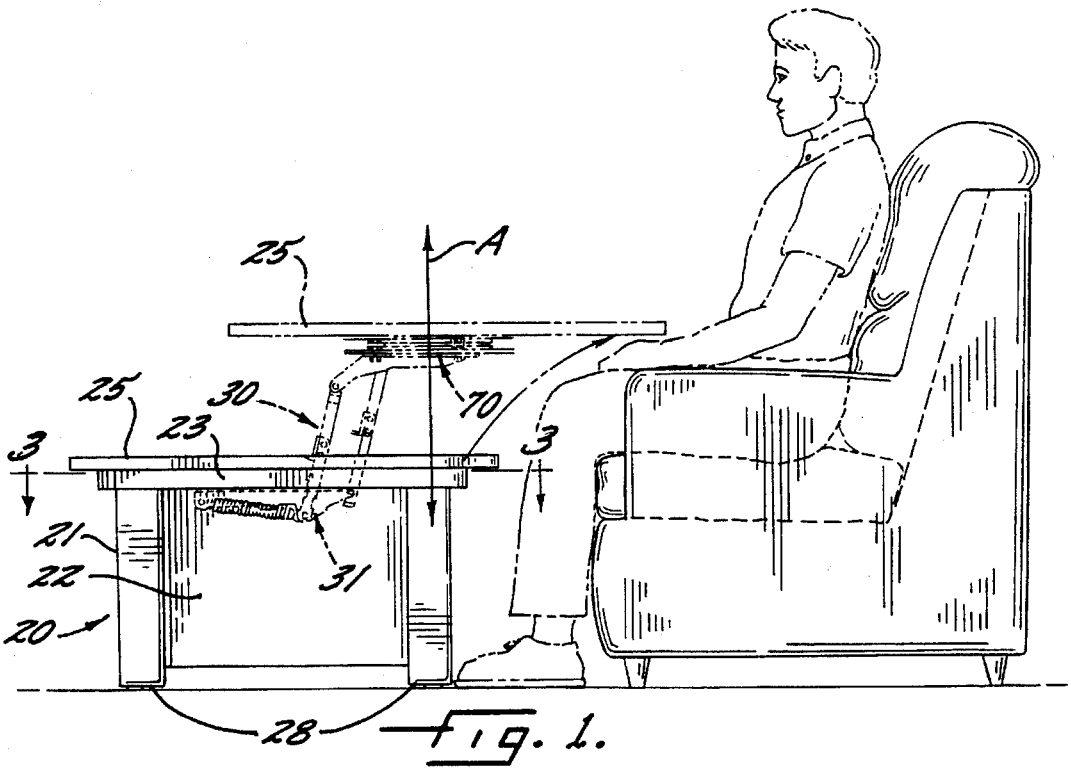
FIG. 1 shows a side elevation view of a coffee table positioned appropriately relative to a sofa and an occupant seated thereon which illustrates both the closed and open positions of the table.

Referring now to the drawings, FIG. 1 shows a coffee table, designated broadly at 20, that includes a stationary base 21 that rests on the floor, a movable table surface 25, a four bar linkage mechanism 30 that controls the movement of the table surface 25 between the open position (shown in solid line in FIG. 1) and the closed position (shown in phantom line in FIG. 1) and a swivel unit 70 that controls the rotational movement of the table surface 25 about an axis of rotation A. Those skilled in this art will appreciate that this invention is not limited to a coffee table as illustrated in FIGS. 1–6 or to an end table as illustrated in FIGS. 7–11, but instead is intended to encompass any table for which dual positions of a rotatable table surface as described above are useful.

The base 21 includes a plurality of support legs 28, a skirt 22, and a mechanism support plate 23. The support legs 28 rest at their lower ends on the floor. The skirt 22 is vertically disposed and is fixed to the upper portions of the support legs 28 so that the outer surface of the skirt forms a visible surface just beneath the rectangular table surface 25. The mechanism support plate 23 (best seen in FIG. 3) is fixed at its perimeter to the upper portions of the support legs 28 and to the inner edges of the skirt 22 so that it is substantially horizontal. The mechanism support plate 23 includes a cavity 24 that includes a central square aperture 29 that is connected at its forward corners to forward slots 27*a*, 27*b* and to its rearward corners to rear slots 26*a*, 26*b*.

The table includes two four bar linkages 30*a*, 30*b* that control the movement of the table surface 25 between the open position and the closed position. As used herein, "four-bar linkage" refers to a series of four structures, or links, each of which is pivotally interconnected to two other links, so that the entire linkage has one degree of freedom of movement. See, e.g., Paul, *Kinematics add Dynamics of Planar Machinery* (Prentice-Hall, Inc., Englewood Cliffs, N.J. 1979). Each four-bar linkage 30*a* comprises a mounting bracket 31, a rear pivot link 40, a front pivot link 50, and a table surface mounting bracket 60. The table has a plane of symmetry P (indicated in FIG. 2) which is normal to the table surface 25 and parallel to and located equidistant from the lateral edges of the table surface 25. The four-bar linkages 30*a*, 30*b* are mirror images of each other across the plane of symmetry P. For brevity and clarity, only one mechanism will be described; those skilled in this art will understand that the description of this linkage applies equally to the mirror image thereof.

The base mounting bracket 31 (FIGS. 4 and 5) includes a horizontal portion 32 and a vertical portion 33. The horizontal portion 32 is a substantially flat plate that includes fastening apertures 34. The mounting bracket is fixed to the underside of the mechanism support plate 23 just lateral of the lateral edge of the cavity 24 by threaded fasteners 35 which are inserted through apertures 34. The vertical portion 33 is fixed substantially perpendicularly to the inwardmost edge of the horizontal portion 32 and extends downwardly therefrom. A rear spring pin 36 is fixed to the rearmost inboard surface of the vertical portion 33. The mounting bracket 31 also includes an aperture 46 for receiving a pivot pin 52, which is positioned at the forwardmost portion of the vertical portion 33, and an aperture 39 for receiving a pivot pin 37 which is positioned rearwardly and slightly downwardly of the aperture 46. Those skilled in this art will appreciate that, although a base mounting bracket is illustrated herein, any means that mounts and pivotally interconnects the rear pivot link 40 and the front pivot link 50 to the base 21 is suitable for use with this invention. Exemplary alternatives include direct pivoted attachment of these limbs to the base, separate mounting brackets for the front and rear pivot links, and the like.

The rear pivot link 40 comprises a body link 41 and a spring extension arm 45. The body link 41 includes an aperture 47 for pivotal interconnection to the base mounting bracket 31 through pivot pin 37, and further includes an aperture 48 for pivotal interconnection to the table surface mounting bracket 60 through a pivot pin 44. Fixed to the central portion of the body link 41 is a rear cross-brace 43 having an L-shaped profile which extends inwardly to a fixed attachment at the same location on the linkage 306 on the opposite side of the table 20. The spring extension arm 45 is fixed substantially perpendicularly to the body link 41 at the aperture 47. A forward spring pin 42 is fixed to the spring extension arm 45 at the end thereof opposite the aperture 37. The forward spring pin 42 extends laterally to receive spring 38, which is attached at its opposite end to the rear spring pin 36.

The front pivot link 50 includes an aperture 54 at one end for pivotal interconnection to the base mounting bracket 31 through pivot pin 52, and also includes an aperture 55 at its opposite end for pivotal interconnection to the table surface mounting bracket 60 through pivot pin 61. At its central portion, the front pivot link 50 is fixed to an upper front cross-brace 51 which extends inwardly to a fixed attachment at the same location on the front pivot link of the linkage 306 on the opposite side of the table 20. At its lowermost portion near the aperture 54, the front pivot link 51 is fixed to a lower cross-brace 53 of hollow square cross-section that also extends to a fixed attachment on the front pivot link of the mechanism on the opposite side of the table.

The table mounting bracket 60 comprises a horizontal portion 63 and a vertical portion 64. The horizontal portion 63 is secured parallel and in contacting adjacent relation to the underside of a swivel unit 70 through threaded fasteners 65, which are inserted through apertures 64. The vertical portion 64 of the table surface mounting bracket 60 is fixed perpendicularly to the lateralmost edge of the horizontal portion 63. The vertical portion 64 includes an aperture 66 at its rearmost portion for pivotal interconnection to the rear pivot link through pivot pin 44, and further includes an aperture 67 positioned upwardly and forwardly of aperture 66 for pivotal interconnection to the front pivot link 50 through the pivot pin 61. Those skilled in this art will appreciate that, although a table surface mounting bracket is illustrated herein, any means that mounts and pivotally interconnects the front pivot link 50 and the rear pivot link 40 with the table surface 25 is suitable for use with this invention. Exemplary alternatives include direct pivotal attachment of these links to a downwardly projecting rib of the table surface, separate mounting brackets for the front and rear point links, and the like. A stop pin 49 is also located on the front portion of the base mounting bracket 31 to halt the forward movement of the mechanism 30*a* in the open position. Those skilled in this art will recognize that any means that can halt the movement of the mechanism 30*a* in the desired position is suitable for use with the invention.

The swivel unit 70 comprises a lower plate 71, an upper plate 74, and a plurality of ball bearings 73. The lower plate 71 is fixed at its lateral portions to the horizontal portions 63 of the mechanisms 30*a*, 30*b* by the insertion of threaded fasteners 65 through apertures 79 into nuts 80. The lower plate 71 includes an upwardly-protruding circular track 72 centered on the lower plate 71. The circular track 72 is substantially semicircular in cross-section and is sized to receive the ball bearings 73. The upper plate 74 is secured at its lateral portions to the underside of the table surface 25 by the insertion of threaded fasteners 78 through apertures 79. The upper plate 74 includes a centrally positioned downwardly-protruding circular track 75 similar in cross-section to circular track 72 which rests atop the ball bearings 73. A threaded fastener 76 extends between the centers of lower plate 71 and upper plate 74 to restrict upward and downward movement of the upper plate 74 relative to the lower plate 71, but to permit rotation of the upper plate 74 (and thereby the table surface 25) relative to the lower plate 71.

The table surface 25 is a substantially planar surface that is disposed substantially horizontally. It induces a visible upper surface 80 that serves as the support surface for items resting on the table. Although a rectangular table surface 25 is illustrated herein, those skilled in this art will understand that the table surface 25 may be of any shape, such as round, square, oval, and the like, and still be suitable for use with the present invention. It is preferred that the table surface 25 be elongated (i.e., having a first length dimension that is greater than a perpendicular second width dimension) such as rectangular, oval, oblong, and the like, so that as it is rotated about the axis of rotation A, the table surface 25 can provide a support surface in different locations relative to the base 21.

Figures 4, 5:
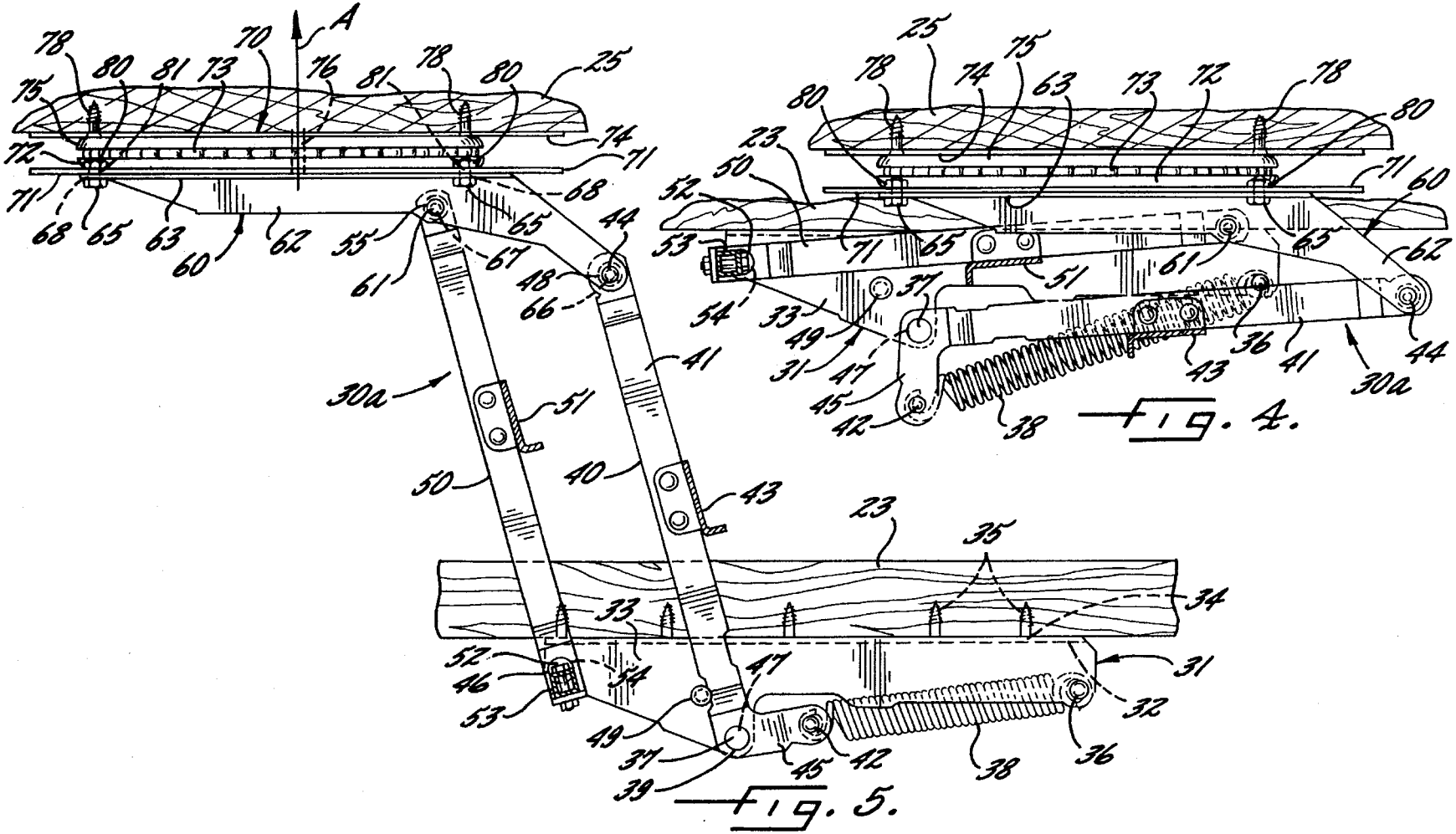
FIG. 4 is a side elevation view of a mechanism in the closed position.
FIG. 5 is a side elevation view of a mechanism in the open, position.

In operation, the table 20 begins in the closed position of FIG. 4. In the closed position, the table surface 25 rests atop the mechanism support plate 23, the skirt 22, and the table surface mounting plates 60 of the four bar linkages 30*a*, 30*b*. For each of the linkages 30*a*, 30*b*, the spring extension arm of the rear pivot link 40 extends downwardly from aperture 47, and the body link 41 of the rear pivot link 40 extends rearwardly and slightly upwardly from aperture 37 to aperture 48. In this position the spring 38 is extended; the tension in the spring 38 biases the mechanism to move toward the open position. The front pivot link 50 extends rearwardly and slightly upwardly from aperture 54 to aperture 55; the front pivot link 50 is substantially parallel to the body link 41 of the rear pivot link 40. In this collapsed position, the linkages 30*a*, 30*b* nest within the rear slots 26*a*, 26*b*, the forward slots 27*a*, 27b, and the lateral portions of the square aperture 29 of the cavity 24.

A particular advantage of this invention is the compact configuration of the four bar linkages 30*a*, 30*b* in the closed position. Generally, the coffee table 20 will be in the closed position the large majority of the time, and will be moved to the open position only to perform certain functions, such as providing a food tray, reading desk, or card table. Because the coffee table 20 is predominantly in the closed position, the appearance of the table in the closed position will likely be important to the owner. It is generally much preferred by the owner that the linkages of the table be hidden from view in the closed position. However, it is also preferred that the pivots 37, 44, 52, and 61 of the mechanism 30 be positioned so that in the closed position, all pivots are not substantially aligned. If aligned, and thus in an "on-center" condition, the table surface 25 can become locked in the closed position and thus can be quite difficult to raise. The linkages 30*a*, 30*b* of the present invention collapse in the closed position so that the pivot pin 37 resides only about 2.5 inches from the visible surface 80 of the table surface 25, and the spring pin 42 resides only about 3 inches from the visible surface 80. Consequently, the entire mechanism, 30*a*, 30*b*, is hidden from view in the closed position by the skirt 22, which hangs approximately 3.5 inches from the underside of the table surface 25. Preferably, the vertical distance between spring pin 42 and the visible table surface 80 is no more than 4 inches; when so configured this invention can be used effectively with most table styles without compromising the appearance of the table. This was not true for many prior art dual height tables, which relied on devices for moving the table surface which restricted their use to certain table styles. The compact configuration is particularly attractive when structures such as the swivelling unit 70 are attached between the linkage 30 and the table 25.

In addition, the mechanisms 30*a* an 30*b* are sufficiently compact that they are able to fit within the periphery of the base 21. Preferably, in the closed position, the horizontal distance between the pivot pin 52 and the pivot pin 44 is between about 14 and 18 inches. As used herein, horizontal distance means the forward-to-rearward distance between of these pivots measured parallel to the table surface 25. In such a configuration, the mechanism 30*a* can fit within the base of the large majority of coffee table styles.

To move the table surface 25 from the open position to the closed position, a upward force is applied to the table surface 25. As the table surface 25 rises in response to the upward force, the attached swivel unit 70 and the table surface mounting bracket 60 also rise. Ascension of the table surface mounting bracket 60 causes the front pivot link 50 to rotate about the pivot pin 52 so that the end of the front pivot link 50 interconnected with the table surface mounting bracket 60 by pivot pin 61 moves upwardly and forwardly. Simultaneously, the rear pivot link 40 rotates about the pivot pin 38 so that the end of the body link 41 interconnected with the table surface mounting bracket 60 by pivot pin 44 moves upwardly and forwardly. The table surface 25 reaches its maximum height as the body link 41 of the rear pivot link 40 and the front pivot link 50 are disposed vertically. The table surface 25 then continues slightly downwardly and forwardly. The movement of the mechanism 30 and the table surface 25 ceases as the front pivot link 50 strikes the stop pin 49.

Movement of the table surface 25 is aided by the tension present in the extended spring 38, which tends to pull the front spring pin 42 toward the rear spring pin 38, and thereby assists the extension of the rear pivot link 40. Assistance of this action can be particularly helpful to a frail operator of the table, as the table surface 25 can be quite heavy in some embodiments.

In the open position, the table surface 25 has moved upwardly and forwardly from its position above and adjacent the base 21. The table surface should be configured so that in the open position, the table surface 25 provides a convenient and comfortable support surface for occupants of the adjacent seating unit without any adjustment of the base 21 of the table relative to the floor. Preferably, in the open position, the table surface will be displaced between about 8 and 11 inches upwardly and about 12 and 16 inches forwardly relative to the base 21 from its location in the closed position.

It is noteworthy that, in this embodiment, when viewed in side elevation (as in FIGS. 4 and 5), the pivot pins 37, 44, 61 and 52 are positioned on the base mounting bracket 31 and the table surface mounting bracket 60 so that in the open position, the closed position, and all intermediate positions, line segments drawn between adjacent pivots pins (i.e., from pivot pins 37 to 44, 44 to 61, 61 to 52, and 52 to 37) form a parallelogram. This parallelogramatic configuration permits the table surface 25 to maintain a substantially horizontal disposition throughout its movement between the open and the closed positions. As used herein, a "substantially horizontal disposition" of the table surface means that the table surface varies from the horizontal plane defined by the floor by no more than about 5 degrees. Those skilled in this art will appreciate that slight adjustment of the positions of the apertures on the table surface mounting bracket 60, the base mounting bracket 31, the front pivot link 50 and the rear pivot link 40 can produce a four bar linkage which causes the table surface to vary slightly from horizontal during operation but still maintain a substantially horizontal disposition. Thus, although a substantial parallelogramatic configuration of a four bar linkage is illustrated herein, the invention encompasses and four-bar linkage means that allows the table surface to maintain a substantially horizontal disposition when travelling between the open and the closed positions. Those skilled in this art will also appreciate that a mechanism can be constructed that does not allow maintenance of a horizontal disposition by the table surface during movement between the closed position and the open position, but which does provide a horizontally disposed table surface in the open and closed positions, although this is generally less preferred.

The table is returned to the closed position from the open position by reversing the motion of the table surface 25. A rearward and slightly upward force on the table surface 25 causes the table surface 25, the swivel unit 70 and the table surface mounting bracket 60 to rise and move rearwardly. This action, which of course causes the pivot pin 61 and the pivot pin 44 to move also, forces the front pivot link 50 to rotate about pivot the 52 pin; similarly, the body link 41 of the rear pivot link 40 rotates about the pivot pin 38. The table surface 25 reaches a maximum height as the body link 41 and the front pivot link 50 are vertically disposed, then begins to descend as it continues rearwardly. The pivot links 40, 50 continue to rotate about their respective pivot 52, 38. The downward and rearward action of the table surface 25 and the pivot links 40, 50 continues until these components return to the configuration of the closed position.

It can be observed that the pivotal movement of the rear pivot link 40 causes the front spring pin 42 to be drawn away from the rear spring pin 36 and thereby place the spring 38 in tension. This tension resists the movement of the table to the closed position and thus prevents the table surface 25 from slamming onto the mounting plate 23, which could otherwise occur when the table surface 25 is moved strength to manipulate the table surface 25 easily. Those skilled in this art will appreciate that, although a spring is illustrated herein, any means for biasing the movement of the linkages 30*a*, 30*b* toward the open position, such as a hydraulic or gas cylinder assembly, is also suitable for use with this invention. Further, the biasing means need not be attached to the mounting bracket 31 and the rear pivot link 40, but instead can be attached to any number of locations on the table mechanism an be operable.

Figure 2:
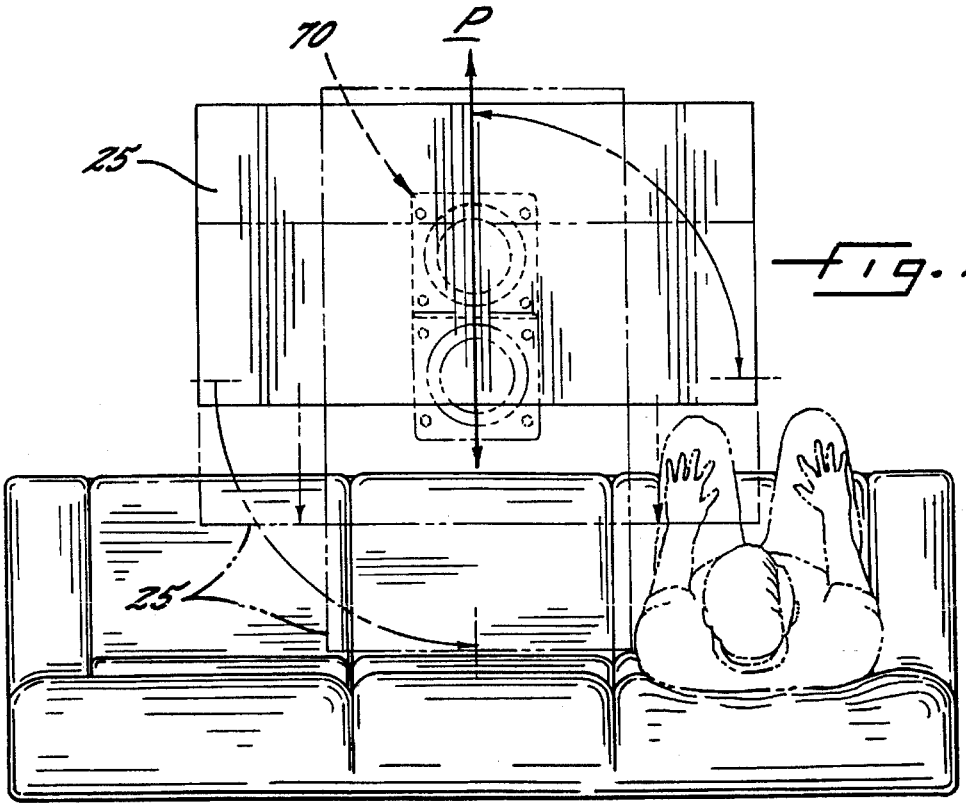
FIG. 2 shows a top view of the coffee table which illustrates the conventional and swivelled positions.
Figure 3:
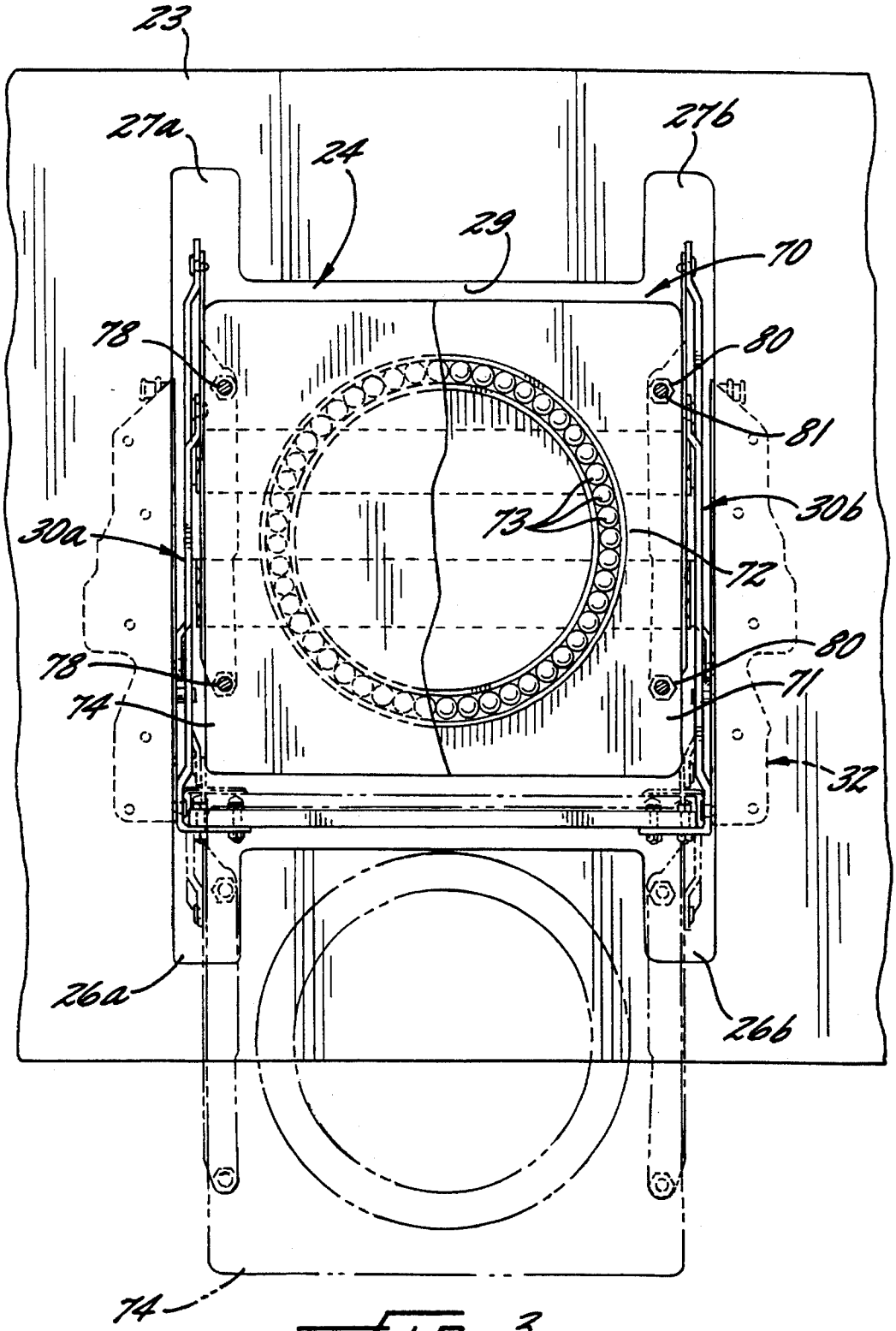
FIG. 3 is an enlarged cutaway view taken along line 3—3 of FIG. 1.

The swivel unit 70 provides means by which the table surface 25 can be rotated relative to the base 21 about axis of rotation A normal to the visible surface 80 of the table 20. Inclusion of this feature is particularly advantageous when used in conjunction with a table having a rectangular table surface (as is illustrated herein), as the table surface 25 can be rotated so that the orientation of the length dimension of the table surface 25 (i.e., from lateral edge to lateral edge) is most convenient for the occupant of the adjacent seating unit. For example, in the illustrated embodiment, FIG. 2 shows how with the table surface 25 oriented so that its length parallels the backrest of the adjacent seating unit, the table surface 25 can provide a support surface, such as a food tray, for occupants seated beside one another on the sofa. Rotation of the table surface 25 90° so that its length is perpendicular to the backrest of the sofa (shown in phantom line in FIG. 2) provides a table surface that resides between occupants seated on either end of the sofa; in this configuration, the table surface 25 can serve as a card table, drink tray, and the like. Also, an occupant seated on either end of the adjacent seating unit can rotate the table surface 25 to this position (i.e., in which the length is perpendicular to the backrest of the sofa) so that he can rise from the sofa without having to lower the table surface to the closed position. Moreover, because of the base 21 being relatively narrow in the lateral direction, swivelling of the table surface 25 to the 90° extended position allows the occupant to extend a footrest from the seating unit without interference from the table 20.

Those skilled in this art will appreciate that, although the ball bearing-driven swivel unit 70 is illustrated herein, any swivel means which permits the table surface 25 to rotate relative to the base in a plane parallel to visible surface 80 of the table 20 is suitable for use with this invention. Exemplary alternative swiveling means include any number of different configuration of bearings, spindles, and the like. Also, though the swivel unit is illustrated as being attached to both table surface mounting brackets of both mechanisms 30, and thus provides an axis center of rotation for the table surface 25 that coincides with the center of the table surface 25, those skilled in this art will appreciate that the swiveling means may be attached to any portion of the table surface that provides an advantageous swivelling motion, and therefore can be attached to provide an eccentric axis of rotation. Further, the swivel means can be attached to only one mechanism, which can also provide an eccentric axis rotation if desired. Finally, the swivel unit 70 can be omitted entirely if swivelling action is not desired.

Figure 6:
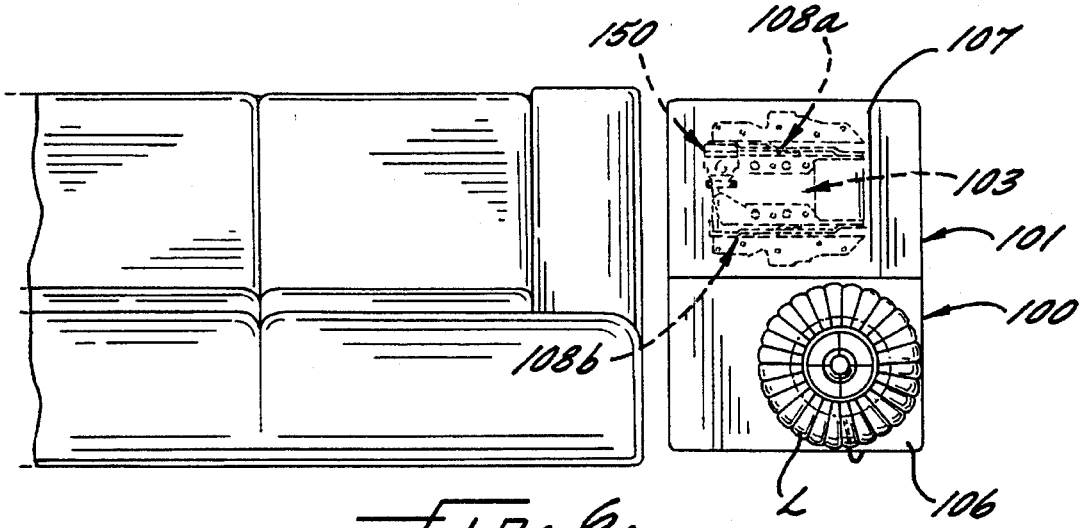
FIG. 6 is a top view of an end table having a stationary and a movable table surface in which the end table is positioned adjacent a sofa.
Figure 7:
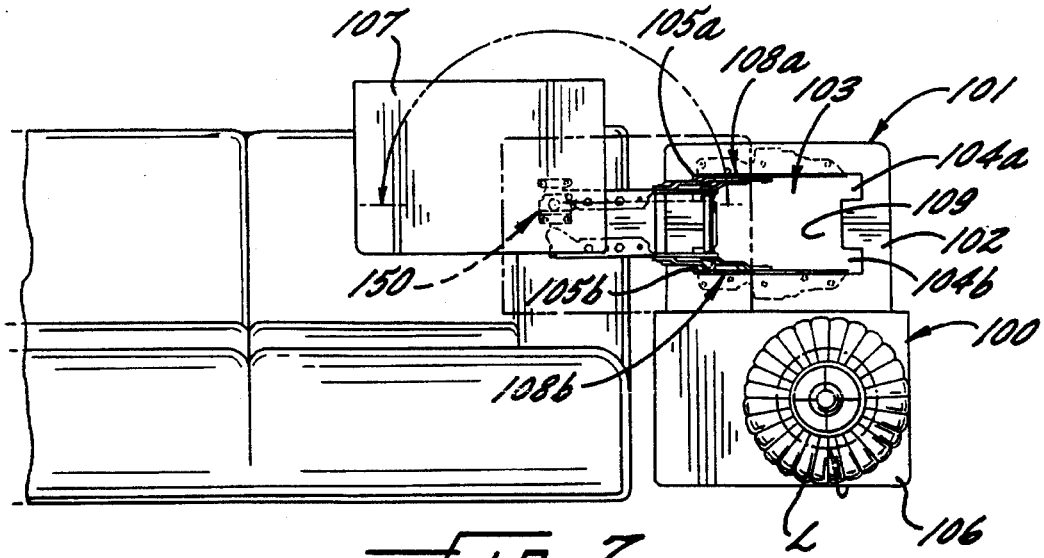
FIG. 7 is a top view of an end table in which the movable table surface is in the open position, and in which the table surface is swivelled to its most extended position.

An alternative embodiment of the invention, in the form of an end table 100, is illustrated in FIGS. 6–10. The end table 100 comprises a base 101, a fixed table surface 106, a movable table surface 107, a pair of four-bar linkages 108*a*, 108*b* that pivotally interconnect the base 101 and the movable table surface 107, and a swivel unit 150. The base 101 includes a mechanism support plate 102, which is fixed about its periphery to the base 101. The mechanism support plate 102 includes an H-shaped opening 103 which comprises a rectangular central cavity 109, two forward slots 105*a*, 105*b* at its forward corners, and two rearward slots 140*a*, 140*b* at its rearward corners (FIG. 7). The fixed table surface 106 is fixed on its underside to the top portion of the base 101. The fixed table surface 106 provides a stationary surface to support objects (such as the illustrated lamp L, a telephone, or the like) that commonly are borne by end tables of this type, although those skilled in this art will appreciate that the invention is also operable with a movable table surface 107 that comprises the entire upper table surface of the end table 100.

The linkages 108*a*, 108*b* (FIGS. 8 and 9) comprise identical four-bar linkages and each are identically mounted on the mechanism support plate 102; the mechanisms differ in the mounting relationship to the movable table surface 107. For clarity and brevity, only mechanism 108*a* will be described in full detail with the exception of the dissimilarity in mounting; those skilled in this art will appreciate that the mechanism 108*b* is configured and operates in the same manner except where noted.

The mechanism 108*a* is a four-bar linkage comprising a base mounting bracket 110, a rear pivot link 120, a front pivot link 130, and a table surface mounting bracket 140. This mechanism controls the action of the movable table surface 107 between the closed position, illustrated in FIG. 6, and the open position illustrated in FIG. 7–10.

The mounting bracket 110 includes a horizontal portion 111 and a vertical portion 112. The horizontal portion 111 is a substantially flat plate that is fixed beneath the mechanism support plate 102 by threaded fasteners 114 inserted through apertures 113 so that it resides just laterally of the lateral edge of the cavity 109. The vertical portion 112 is fixed substantially perpendicularly to the inwardmost edge of the horizontal portion 111 and extends downwardly therefrom. A rear spring pin 116 is fixed to the rearmost inboard surface of the vertical portion 112. The mounting bracket 110 also includes an aperture 119 positioned at the forwardmost portion of the vertical portion 112 for receiving a pivot pin 132, and an aperture 126 positioned rearwardly and slightly downwardly of the aperture 119 for receiving a pivot pin 132. In addition, a stop pin 118 is fixed to and extends inwardly from the inboard surface of the vertical portion 112 of the mounting bracket 110.

The rear pivot link 120 comprises a body link 121 and a spring extension arm 125. The body link 121 includes an aperture 12 for pivotal interconnection to the base mounting bracket 110 through a pivot pin 117, and further includes an aperture 128 for pivotal interconnection to the table surface mounting bracket 140 through a at pivot pin 124. The spring extension arm 125 is fixed substantially perpendicularly to the body link 111 at the aperture 127. A forward spring pin 123 is fixed to the end of the spring extension arm 125 opposite the pivot 117. The forward spring pin 123 extends laterally to receive spring 115, which is attached at its opposite end to the rear spring pin 116.

The front pivot link 130 includes an aperture 133 at one end for pivotal interconnection to the base mounting bracket 110 through pivot pin 132, and also includes an aperture 134 at its opposite end for pivotal interconnection to the table surface mounting bracket 140 at pivot 145. At its lowermost portion near the aperture 133, the front pivot link 121 is fixed to a lower cross-brace 131 that extends to a fixed attachment on the front pivot link of the mechanism **108*b* on the opposite side of the table 100**.

The table surface mounting bracket 140 comprises a horizontal portion 141 and a vertical portion 142. The vertical portion 142 is fixed perpendicularly to the outermost edge of the horizontal portion 141. The vertical portion 142 includes an aperture 147 at its rearmost portion for pivotal interconnection to the rear pivot link 120 through pivot pin 124, and further includes an aperture 148 positioned upwardly and forwardly of aperture 147 for pivotal interconnection to the front pivot link 130 through a pivot pin 145.

The shim plate 180 (FIG. 9) extends between the linkages **108*a*, 108*b* to provide stability and uniformity of motion. The shim plate 180 includes a contact surface 181 that is fixed to the underside of the horizontal portion 141 of the table surface mounting bracket 140 by threaded fasteners 144, which are inserted through apertures 184. The contact surface 181 merges at its forward edge to a sloped transition surface 182, which then merges at its forward edge into a horizontal spacing surface 183. The spacing surface 183 includes a rivet aperture 185 for receiving rivet assembly 170. A vertical shimming surface 186 originates at the forward edge of the spacing surface 183 and extends upwardly to rest against the underside of the horizontal portion 141**.

The table surface mounting bracket 140 of linkage **108*a* is secured by its horizontal portion 141 to the swivel unit 150. The swivel unit 150 comprises a swivel collar 151 and a rivet pin assembly 170. The collar 151 includes a lower surface 152 which includes aperture 157. The collar 151 further includes a forward extension tab 153 fixed to its forward portion and a rear extension tab 154 fixed to its rear portion. The forward extension tab 153 has a forward stop edge 155 that extends substantially radially from the aperture 155. Similarly, the rear extension tab 154 has a rear stop edge 156. Each of the stop edges 155, 156 is positioned from the aperture 157 to receive the stop pin 146. The lower surface 152 merges at its inward edge to a sloped surface 158, which then merges into a horizontal medial upper surface 160; similarly, the lower surface 152 merges at its inward edge to a sloped surface 159, which then merges into a horizontal lateral upper surface 160. The upper surfaces 160, 161 are separated in elevation from the lower surface 152 sufficiently to clear the stop pin 146 as the collar 151 rotates. The upper surfaces 160, 161 are fixed to the underside of the movable table surface 107 by threaded fasteners 163, which extend through apertures 162**.

The rivet assembly 170 comprises a rivet 171 having a head 172 that rests atop and adjacent the lower surface 152 of the collar 151, a shank 173 that extends through apertures 157, 149, and 185, and a flange 174 that rests beneath and adjacent the underside of the spacing surface 183. Bushings 175 and 176 are positioned to separate the flange 174 from the spacing surface 183 and the collar 152 from the horizontal portion 141, respectively.

The horizontal portion 141 of the table surface mounting bracket 140 of the linkage **108*b* is mounted to a spacer 190 of approximately the same thickness as the swivel unit 150 of mechanism 108*a*. The spacer is not attached to the movable table surface 107, but instead rests underneath the table surface. In this configuration, the spacer 190 can provide support to the movable table surface 107 in both the closed and open positions, but because the spacer 190 does not restrain movement of the movable table surface in a plane coincident with the movable table surface 107, the table surface 107 is free to rotate about the swivel unit 150**.

In operation, the end table 100 begins in the closed position of FIG. 6. In the closed position, the movable table surface 107 rests atop the upper edge of the base 101, the spacer 170, and the swivel unit 150. The remainder of the mechanisms **108*a*, 108*b* take the same general configuration as that shown in FIG. 4 for the first embodiment described. As described earlier, the mechanism preferably folds to a closed position in which the distance between the spring pin 123 and the visible table surface is no more than about 40 inches. The horizontal distance between pivot pins 132 and 128** is preferably between about 9 and 12 inches for this embodiment.

To move the movable table surface 107 from the closed position to the open position (FIG. 7), an upward force is applied to the movable table surface 107. As the movable table surface 107 rises in response to the upward force, the attached swivel unit 150 and the table surface mounting bracket 140 also rise. Ascension of the table surface mounting bracket 140 causes the front pivot link 130 to rotate about the pivot pin 132 so that the end of the front pivot link 130 interconnected with the table surface mounting bracket 140 at the pivot pin 145 moves upwardly and forwardly. Simultaneously, the rear pivot link 120 rotates about the pivot pin 117 so that the end of the body link 41 interconnected with the table surface mounting bracket 140 at the pivot pin 124 moves upwardly and forwardly. This motion is aided by the tension in the spring 115, which tends to pull the front spring pin 123 toward the rear spring pin 116. The movable table surface 107 reaches its maximum height as the body link 121 of the rear pivot link 120 and the front pivot link 130 are disposed vertically. The movable table surface 107 then continues slightly downwardly and forwardly. The movement of the linkages **108*a*, 108*b* and the movable table surface 107 ceases as the rear pivot link 120 strikes the stop pin 118**.

It should also be noted that, for an end table such as that illustrated, it is preferred that the movable table surface 107 and the mechanisms **108*a*, 108*b* travel toward and rest in the open position following a path which will not interfere with the armrests of typical seating units. Thus, preferably, the table surface 107** will be displaced between about 4 and 6 inches upwardly and about 8 and 11 inches forwardly in traveling from the closed to the open position.

To move the movable table surface 107 from the open position to the closed position, an upward force is applied to the movable table surface 107. As the movable table surface 107 rises in response to the upward force, the attached swivel unit 150 and the table surface mounting bracket 140 also rise. Ascension of the table surface mounting bracket 140 causes the front pivot link 130 to rotate about the pivot pin 132 so that the end of the front pivot link 130 interconnected with the table surface mounting bracket 140 at the pivot pin 145 moves upwardly and forwardly. Simultaneously, the rear pivot link 120 rotates about the pivot pin 117 so that the end of the body link 41 interconnected with the table surface mounting bracket 140 at the pivot pin 124 moves upwardly and forwardly. This motion is aided by the tension in the spring 115, which tends to pull the front spring pin 123 toward the rear spring pin 116. The movable table surface 107 reaches its maximum height as the body link 121 of the rear pivot link 120 and the front pivot link 130 are disposed vertically. The movable table surface 107 then continues slightly downwardly and forwardly. The movement of the linkages 108*a*, 108*b* and the movable table surface 107 ceases as the rear pivot link 120 strikes the stop pin 118.

Figures 8, 9, 10:
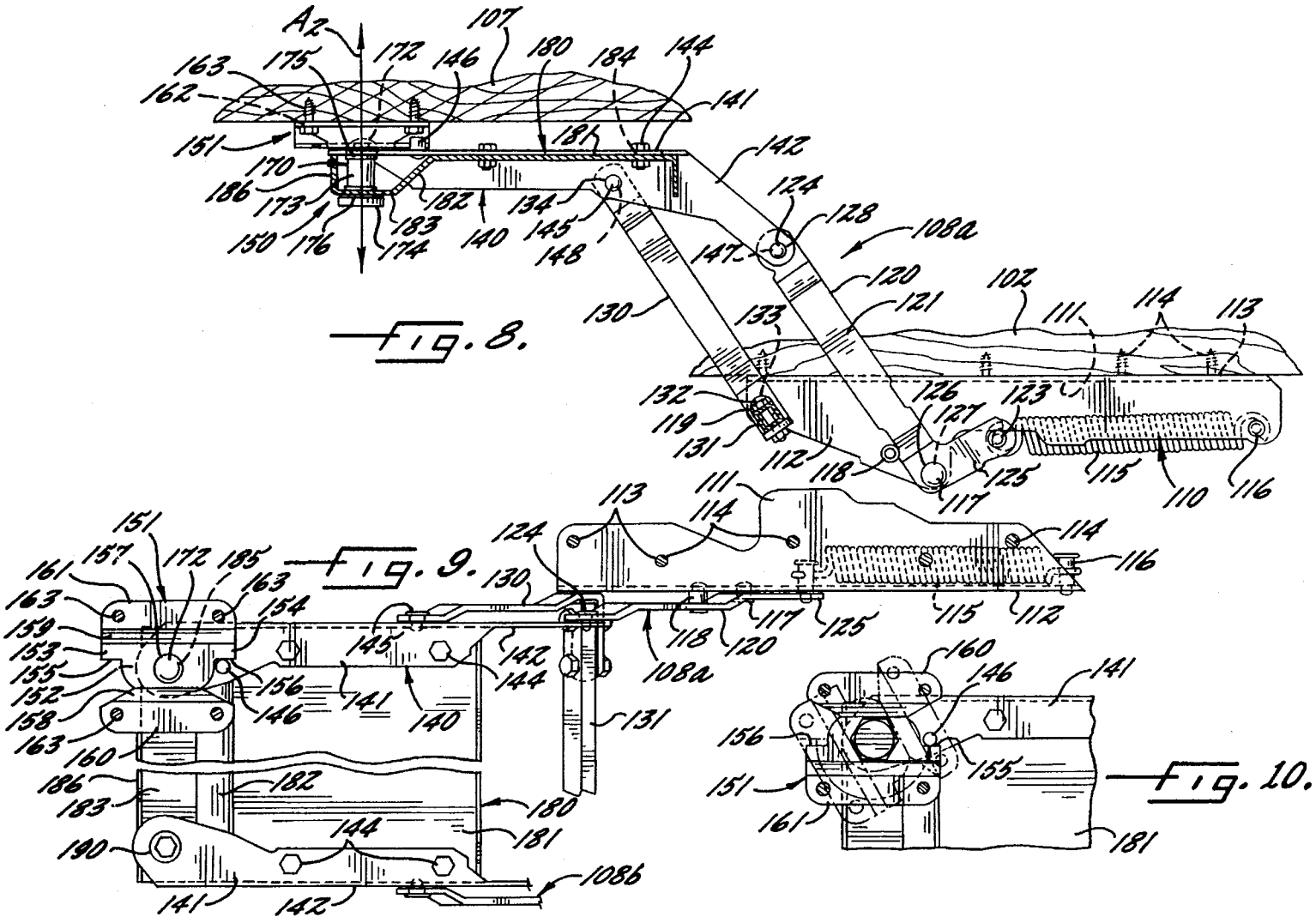
FIG. 8 is a side view of an end table mechanism in the open position.
FIG. 9 is a cutaway top view of an end table mechanism in the open position in which the table surface is in its unswivelled position.
FIG. 10 is a cutaway view of an end table mechanism in which the table surface is in its extended swivelled position.

In addition, the presence of the swiveling unit 150 on mechanism 108*a* allows the table surface 107 to rotate about the axis of rotation $A_2$ (FIG. 10). An operator need only apply a force to the movable table surface 107 in the direction away from the fixed table surface 106 to cause the movable table surface 107 to begin to rotate. In doing so the rearwardmost edge of the movable table surface 107 moves away from the fixed table surface 106 (counterclockwise as seen in FIGS. 6 and 7). Rotation can continue for approximately 180 degrees until the rearward stop edge 155 of the collar 151 contacts the stop pin 146. The table surface can then be returned to its original position by reversing the direction of rotation.

The preferred embodiment has an eccentric axis of rotation relative to the movable table surface 107. Because the axis of rotation is forward of rather than coincident with the center of the movable table surface 107, in its fully rotated position the movable table surface is able to extend a greater distance from the base 101 toward and over a seating unit than would a table surface rotating about its center. In this position it can be envisioned that more of the table surface 107 may be available for use by an occupant of the seating unit. Preferably, the axis of rotation is shifted between about 4 and 8 inches forward of the center of the table surface 107.

Further, because the axis of rotation is positioned lateral of the center of the movable table surface 107 away from the fixed table surface 106, in the fully rotated position the movable table surface is spaced farther from the backrest of the seating unit. By the table surface 107 being so spaced, the occupant of the seating unit has more maneuvering room behind the table surface 107. Preferably, the axis of rotation is shifted laterally between about 1 and 4 inches from the center of the table surface in the direction away from the fixed table surface 106. Those skilled in this art will appreciate that although an axis of rotation that is eccentric in both the forward and lateral directions is preferred, a table having a center of rotation that is eccentric in only one of these directions or even in neither direction (i.e., the center of the movable table surface and the axis of rotation are coincident) is encompassed by the present invention.

The foregoing embodiments are illustrative of the present invention, and are not to be construed as limiting thereof. The invention is defined by the following claims, with equivalents of the claims to be included therein.

That which is claimed is:

1. A table comprising:

(a) a base;

(b) a substantially planar table surface having an uppermost visible surface and being movable between a closed position, wherein said table surface is horizontally disposed adjacent and above said table base, and an open position, in which said table surface is horizontally disposed above and forward of said table base;

(c) four bar linkage means interconnecting said table surface with said base for moving said table surface between the open position and the closed position;

(d) swivel means for rotating said table surface about an axis of rotation normal to a plane defined by said uppermost visible surface, said swivel means being attached to said table surface and attached to said four bar linkage means; and (e) a stationary table surface fixed and immovable relative to said table base adjacent to and coplanar with said movable table surface when said movable table surface is in the closed position.

2. A table according to claim 1, wherein said table surface is oblong.

3. A table according to claim 1, wherein said four bar linkage means comprises a plurality of four bar linkages.

4. A table according to claim 3, wherein each of said plurality of four bar linkages comprises:

(a) table base mounting means adapted to be fixed to said table base;

(b) a front pivot link pivotally interconnected to said table base mounting means at a first pivot;

(c) a rear pivot link pivotally interconnected to said table base mounting means at a second pivot, said second pivot being positioned rearward of said first pivot; and (d) table surface mounting means adapted to be fixed to a table surface, said table surface mounting means being pivotally interconnected to said front pivot link at a third pivot, and being further pivotally interconnected to said rear pivot link at a fourth pivot, said fourth pivot being positioned rearward of said third pivot.

5. A table according to claim 4, wherein in the closed position, the distance between said first pivot and said visible surface is less than about 4 inches, and the distance between said second pivot and said visible surface is less than about 4 inches.

6. A table according to claim 4, wherein said table surface mounting means is a table surface mounting link and wherein said swivel means is attached to said table surface mounting link.

7. A table according to claim 4, wherein the distance between said first pivot and said third pivot is substantially equal to the distance between said second pivot and said fourth pivot, and wherein the distance between said first pivot and said second pivot is substantially equal to the distance between said third pivot and said fourth pivot.

8. A table according to claim 1, wherein said four bar linkage means further comprises means for biasing said table surface from the closed position into the open position.

9. A table according to claim 1, wherein said four bar linkage means further comprises stop means for discontinuing the movement of said table surface as it reaches the open position.

10. A table according to claim 1, wherein in the open position, said table surface is displaced between about 12 and 16 inches forward of and between about 8 and 11 inches above its position in the closed position.

11. A table according to claim 1, wherein in the open position, said table surface is displaced between about 7 and 11 inches forward of and between about 4 and 6 inches above its position in the closed position.

12. A table according to claim 1, wherein said axis of rotation is both forwardly and laterally offset from the center of the table surface.

13. A table according to claim 1, wherein said swivel means further comprises stop means for restricting the rotation of said table surface between a first retracted rotative orientation and a second extended rotative orientation.

14. A table comprising a base, a substantially planar table surface having an uppermost visible surface, and a mechanism interconnecting said table surface and said base, said table surface being movable between a closed position, wherein said table surface is horizontally disposed adjacent and above said table base, and an open position, in which said table surface is horizontally disposed above and forward of said table base, said mechanism comprising:

(a) four bar linkage means comprising:

(i) table base mounting means fixed to said table base;

(ii) a front pivot link pivotally interconnected to said table base mounting means at a first pivot;

(iii) a rear pivot link pivotally interconnected to said table base mounting means at a second pivot, said second pivot being positioned rearward of said first pivot; and (iv) table surface mounting means being pivotally interconnected to said front pivot link at a third pivot, and being further pivotally interconnected to said rear pivot link at a fourth pivot, said fourth pivot being positioned rearward of said third pivot; and (b) swivel means for rotating said table surface about an axis of rotation normal to a plane defined by said visible table surface, said swivel means being attached to said four bar linkage means and said table surface so that the axis of rotation of said table surface is offset forwardly and laterally from the center of said table surface.

15. A table according to claim 14, wherein said table surface mounting means is a table surface mounting link.

16. A table comprising:

(a) a base;

(b) a substantially planar table surface having an uppermost visible surface and being movable between a closed position, wherein said table surface is horizontally disposed adjacent and above said table base, and an open position, in which said table surface is horizontally disposed above and forward of said table base;

(c) four bar linkage means comprising:

(i) table base mounting means fixed to said base;

(ii) a front pivot link pivotally interconnected to said table base mounting means at a first pivot;

(iii) a rear pivot link pivotally interconnected to said table base mounting means at a second pivot said second pivot being positioned rearwardly from said first pivot, said rear pivot link including an extension arm that extends generally rearwardly from said second pivot when said table surface is in the open position; and (iv) table surface mounting means attached fixed to a table surface, said table surface mounting means being pivotally interconnected to said front pivot link at a third pivot, and being further pivotally interconnected to said rear pivot link at a fourth pivot, said fourth pivot being positioned rearwardly from said third pivot; and (d) table surface biasing means attached to said extension arm of said rear pivot link and to said table base mounting means for biasing said table surface toward the open position;

wherein in the closed position, the vertical distance between said first pivot and said visible surface is less than about 4 inches, the vertical distance between said second pivot and said visible surface is less than about 4 inches, and the vertical distance between the lowermost portion of said biasing means and said visible surface is less than about 4 inches.

17. A table according to claim 14, wherein said table base mounting means is a table base mounting link.

18. A table according to claim 14 further comprising biasing means which tends to urge said mechanism from the closed position to the open position.

19. A table according to claim 14, further comprising stop means for discontinuing the movement of the mechanism in the open position.

20. A table according to claim 19, wherein said stop means is integrally formed with said table base mounting means.

21. A table according to claim 14, wherein said swivel means further comprises stop means for restricting the rotation of said table surface between a first retracted rotative orientation and a second extended rotative orientation.

22. A table according to claim 14, wherein said four bar linkage means further comprises;

first means for stabilizing said four bar linkage means attached to each of said pair of front pivot links; and second means for stabilizing said four bar linkage means attached to each of said pair of rear pivot links.

23. A table according to claim 14, wherein said four bar linkage means comprises a pair of four bar linkages, and wherein said swivel means is attached to said table surface mounting means of one of said four bar linkages.

24. A table according to claim 14, wherein said table surface is oblong.

25. A table according to claim 14, further comprising a stationary table surface attached to said table base adjacent to and parallel to said movable table surface.

26. A table according to claim 14, wherein said four bar linkage means further comprises a plurality of four bar linkages.

27. A table according to claim 16, wherein said second pivot is positioned downwardly from said first pivot on said table base mounting means.

28. A table according to claim 16, wherein said table surface mounting means is a table surface mounting link.

29. A table according to claim 16, wherein said table base mounting means is a table base mounting link.

30. A table according to claim 16, wherein said biasing means comprises a spring.

31. A table according to claim 16, wherein said four bar linkage means further comprises stop means for discontinuing the movement of said table surface as it reaches the open position.

32. A table according to claim 31, wherein said stop means is integrally formed with said table base mounting means.

33. A table according to claim 16, wherein in the open position, said table surface is displaced between about 12 and 16 inches forward of and between about 8 and 11 inches above its position in the closed position.

34. A table according to claim 16, wherein in the open position, said table surface is displaced between about 7 and 11 inches forward of and between about 4 and 6 inches above its position in the closed position.

35. A table according to claim 16, wherein in the closed position, the horizontal distance between said second pivot and said third pivot is between about 14 and 18 inches.

36. A table according to claim 16, wherein said four bar linkage means comprises a pair of substantially identical four bar linkages.

37. A table according to claim 16, wherein said four bar linkage means further comprises;

first means for stabilizing said four bar linkage means attached to each of said pair of front pivot links; and second means for stabilizing said four bar linkage means attached to each of said pair of rear pivot links.

38. A table according to claim 37, wherein said four bar linkage means further comprises third means for stabilizing said pair of four bar linkages attached to said table surface mounting means.

39. A table according to claim 16, wherein said four bar linkage means comprises a plurality of four bar linkages.

40. A table according to claim 16, further comprising a stationary table surface attached to said table base adjacent to and parallel to said movable table surface.

41. A table according to claim 16, wherein said table surface is oblong.

* * * * *